US005190163A

United States Patent [19]

Anzai et al.

[11] Patent Number: 5,190,163

[45] Date of Patent: Mar. 2, 1993

[54] SORTING APPARATUS UTILIZING TRANSMITTED LIGHT

[75] Inventors: Kazuyoshi Anzai; Akira Shibayama, both of Chiba; Susumu Hirano; Hajime Sasaki, both of Kanagawa, all of Japan

[73] Assignees: Anzai Sogo Kenkyusho Co., Ltd.; Morinaga & Co., Ltd., both of Japan

[21] Appl. No.: 873,875

[22] Filed: Apr. 22, 1992

Related U.S. Application Data

[63] Continuation of Ser. No. 545,435, Jun. 28, 1990, abandoned.

[30] Foreign Application Priority Data

Oct. 3, 1989 [JP] Japan ..... 1-258240

[51] Int. Cl.[5] ..... B07C 5/342

[52] U.S. Cl. ..... 209/588; 209/577; 209/582; 250/223 R; 250/226; 250/228; 356/236

[58] Field of Search ..... 209/576, 577, 578, 579, 209/580–582, 585, 588; 356/236, 384, 385; 250/223 R, 226, 228

[56] References Cited

U.S. PATENT DOCUMENTS

| | | | |
|---|---|---|---|
| 3,197,647 | 7/1965 | Fraenkel | 209/639 X |
| 3,781,554 | 12/1973 | Krivoshiev et al. | 209/582 X |
| 3,930,994 | 1/1976 | Conway et al. | 209/579 |
| 4,186,838 | 2/1980 | Levitt et al. | 209/576 X |
| 4,204,950 | 5/1980 | Burford, Jr. | 209/582 X |
| 4,260,062 | 4/1981 | Lockett | 209 0/582 |
| 4,279,346 | 7/1981 | McClure et al. | 209/582 |
| 4,395,126 | 7/1983 | Kramer | 250/228 X |
| 4,658,131 | 4/1987 | Stark | 356/236 X |
| 4,666,045 | 5/1987 | Gillespie et al. | 209/585 |

FOREIGN PATENT DOCUMENTS

| | | | |
|---|---|---|---|
| 0361430 | 4/1990 | European Pat. Off. . | |
| 7247 | 1/1984 | Japan | 356/236 |
| 1370147 | 10/1974 | United Kingdom . | |
| 1521406 | 8/1978 | United Kingdom . | |
| 1560446 | 2/1980 | United Kingdom . | |
| 215018 | 7/1985 | United Kingdom . | |
| 2165644 | 4/1986 | United Kingdom | 209/581 |

*Primary Examiner*—Donald T. Hajec

*Attorney, Agent, or Firm*—Caesar, Rivise, Bernstein, Cohen & Pokotilow, Ltd.

[57] ABSTRACT

A sorting apparatus is disclosed which utilizes transmitted light to determine whether or not an article under inspection is defective in order to reject any article determined to be defective. A light irradiator is provided on irradiating an article being inspected with a light beam having a smaller diameter than that of an article, and a light condenser is provided for condensing the rays of light transmitted through the article while being diffused. Two light detectors respectively detect two specific kinds of light having different wavelengths from among the condensed rays of light transmitted through the article. A ratio is obtained between the intensities of the two specific kinds of light detected by the light detector and compared with a predtermined ratio in order to determine whether the article under inspection has undergone deterioration in quality.

12 Claims, 7 Drawing Sheets

REFERENCE OF COMPARATOR 17
REFERENCE OF COMPARATOR 20
β
α
γ
δ
0V
0V
I (AMPLIFIER 11 E(λ1))
II (AMPLIFIER 12 E(λ2))
III (ADDER 16)
IV (COMPARATOR 19)
V (COMPARATOR 17.20)

SORTING APPARATUS UTILIZING TRANSMITTED LIGHT

This application is a continuation of application Ser. No. 07/545,435, filed Jun. 28, 1990 now abandoned.

BACKGROUND OF THE INVENTION

1. Field of the Invention

The present invention relates to a sorting apparatus designed to determine whether or not food articles, for example, nuts, are defective on the basis of transmitted light and to enable rejection of defective articles.

2. Description of the Prior Art

Nuts, corn and the like may deteriorate in quality due to fungi. Some fungus strains produce aflatoxins, which are extremely carcinogenic. Nuts which have been contaminated with such fungus strains are therefore inedible and must be sorted out in advance of packaging.

As a conventional method of sorting nuts, there has been a color sorting method wherein defective foods are identified by detection of the surface color change of articles (nuts). The color sorting method suffers, however, from the following problems. Although it is effective for articles the surfaces of which have undergone a color change due to an internal deterioration, it is ineffective for those which have not undergone any surface color change, and the appearance of which is indistinguishable from non-defective articles, although there has been an internal deterioration in quality. Articles in which a deterioration in quality is not evident from a surface color change are also difficult to identify by eye.

SUMMARY OF THE INVENTION

In view of the above-described circumstances, it is a primary object of the present invention to provide a sorting apparatus which is capable of sorting out defective articles which have no surface color change despite an internal deterioration in quality.

To this end, the present invention provides a sorting apparatus utilizing transmitted light to determine whether or not an article under inspection is defective and thus to enable a defective article to be rejected. The invention includes: a light irradiator for irradiating the article under inspection with a light beam having a smaller diameter than that of the article under inspection; a light condenser for condensing the rays of light transmitted through the article under inspection while being diffused; two light detecting means for respectively detecting two specific kinds of light having different wavelengths from among the condensed rays of transmitted light; and a judging means for judging whether or not the article under inspection is defective by obtaining a ratio between the intensities of the two specific kinds of light detected by the light detecting means and judging whether or not the obtained ratio is higher than a predetermined value.

Our studies have revealed that light having wavelengths of from 500 nm to 1400 nm can pass through nuts. In other words, it is possible to judge the internal condition of nuts by the utilization of light having wavelengths within this range.

FIG. 1 is a graph showing the results of an experiment wherein non-defective nuts (a) and defective nuts (b) were irradiated with light varying in wavelength from 500 nm to 1500 nm to examine the resulting diffuse transmission factors. As will be clear from FIG. 1, non-defective nuts and defective nuts exhibit different diffuse transmission factors. FIG. 2 is a graph showing the difference in the diffuse transmission factor between the non-defective nuts (a) and the defective nuts (b) shown in FIG. 1. As will be understood from this graph, the difference in diffuse transmission factor between the non-defective nuts and the defective nuts is large near the wavelengths 1100 nm and 750 nm. The ratio of the diffuse transmission factor at the wavelength of 1100 nm to that at the wavelength of 750 nm is obtained from the graph shown in FIG. 1, as follows:

For non-defectives:

$$2.1\% \ (1100\ nm)/1.2\% \ (750\ nm)=1.75$$

For defectives:

$$2.8\% \ (1100\ nm)/0.39\% \ (750\ nm)=7.18$$

Thus, it is possible to judge whether or not nuts have undergone any internal deterioration in quality by checking the ratio of the transmission factor at the wavelength of 1100 nm to that at the wavelength of 750 nm.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and of which.

DETAILED DESCRIPTION OF THE PREFERRED EMBODIMENTS

One embodiment of the present invention will be described below with reference to the accompanying drawings.

Figure 1:
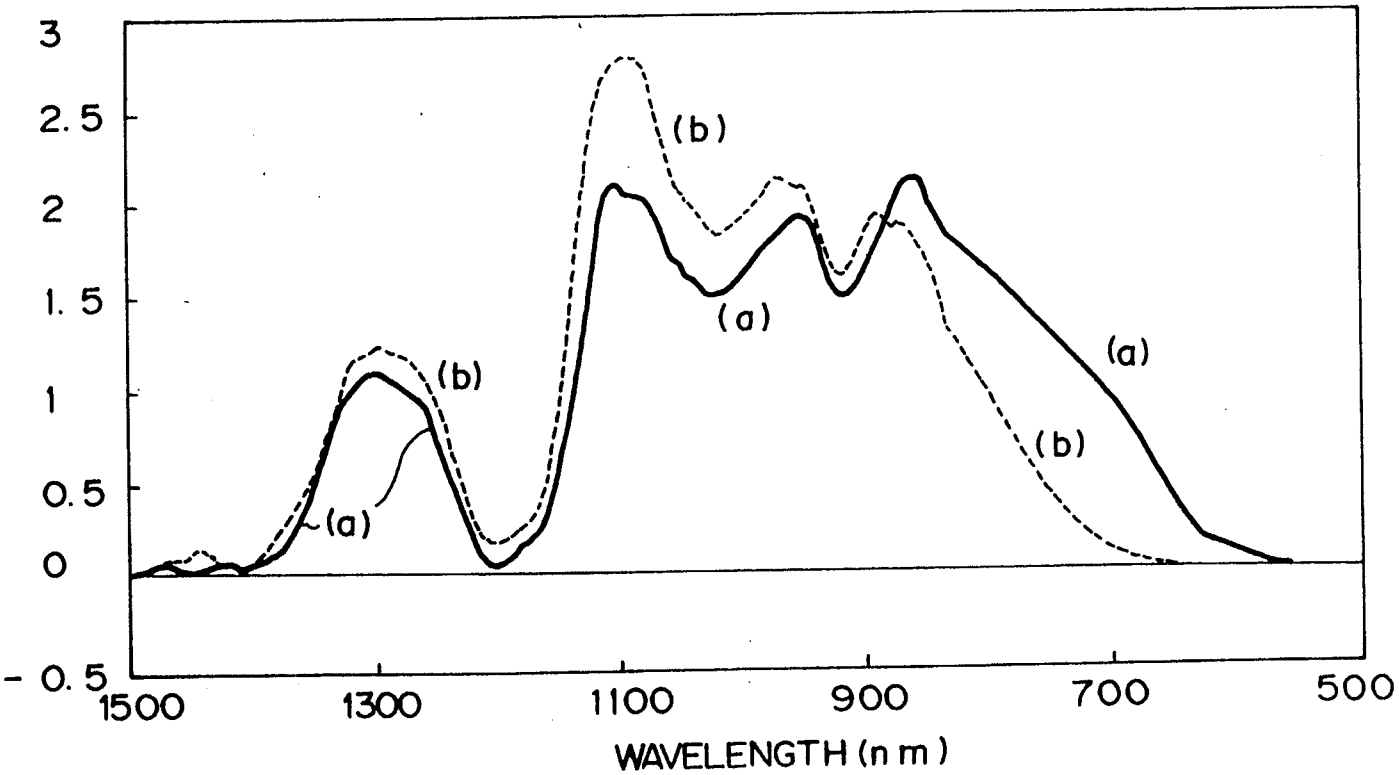
FIG. 1 is a graph showing the diffuse transmission factors of non-defective articles and defective articles.
Figure 2:
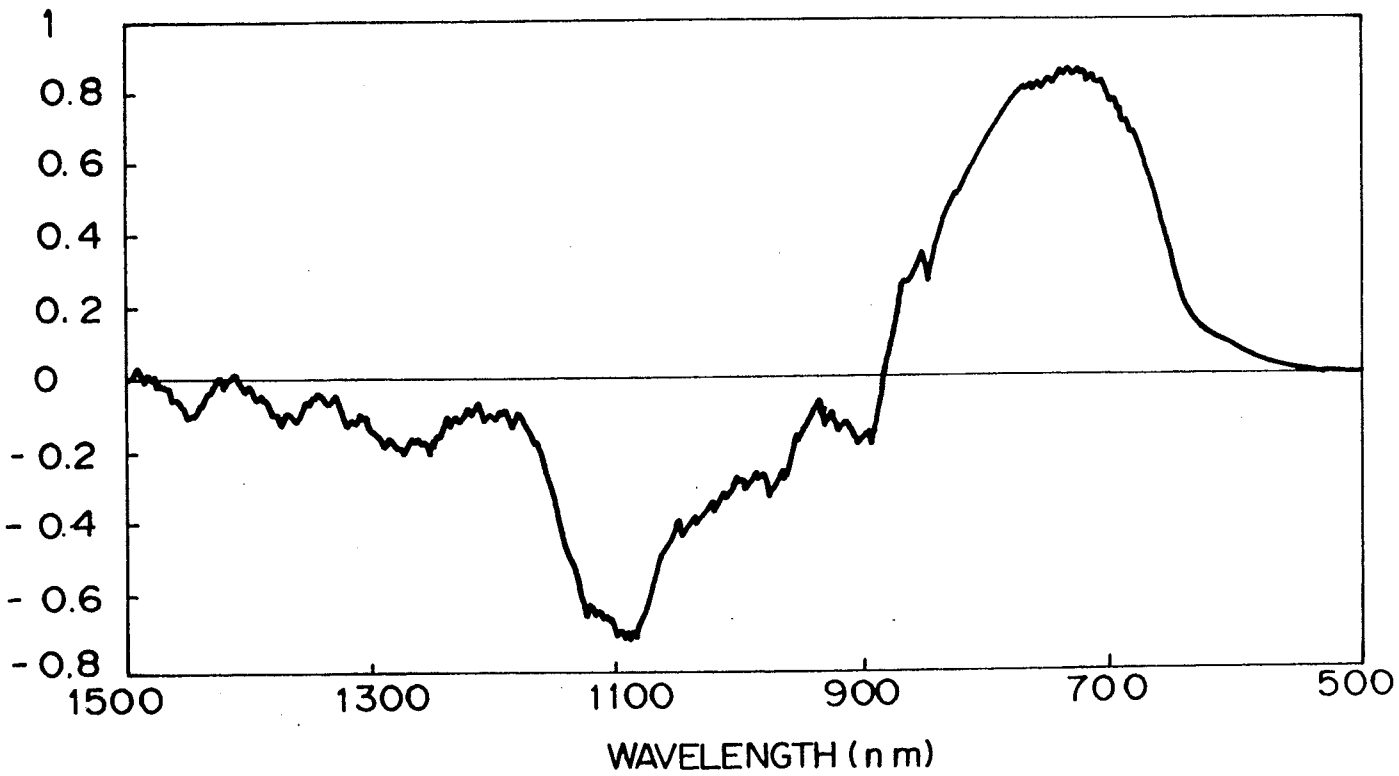
FIG. 2 is a graph showing the difference in the diffuse transmission factor between the non-defective articles and the defective articles.
Figure 3:
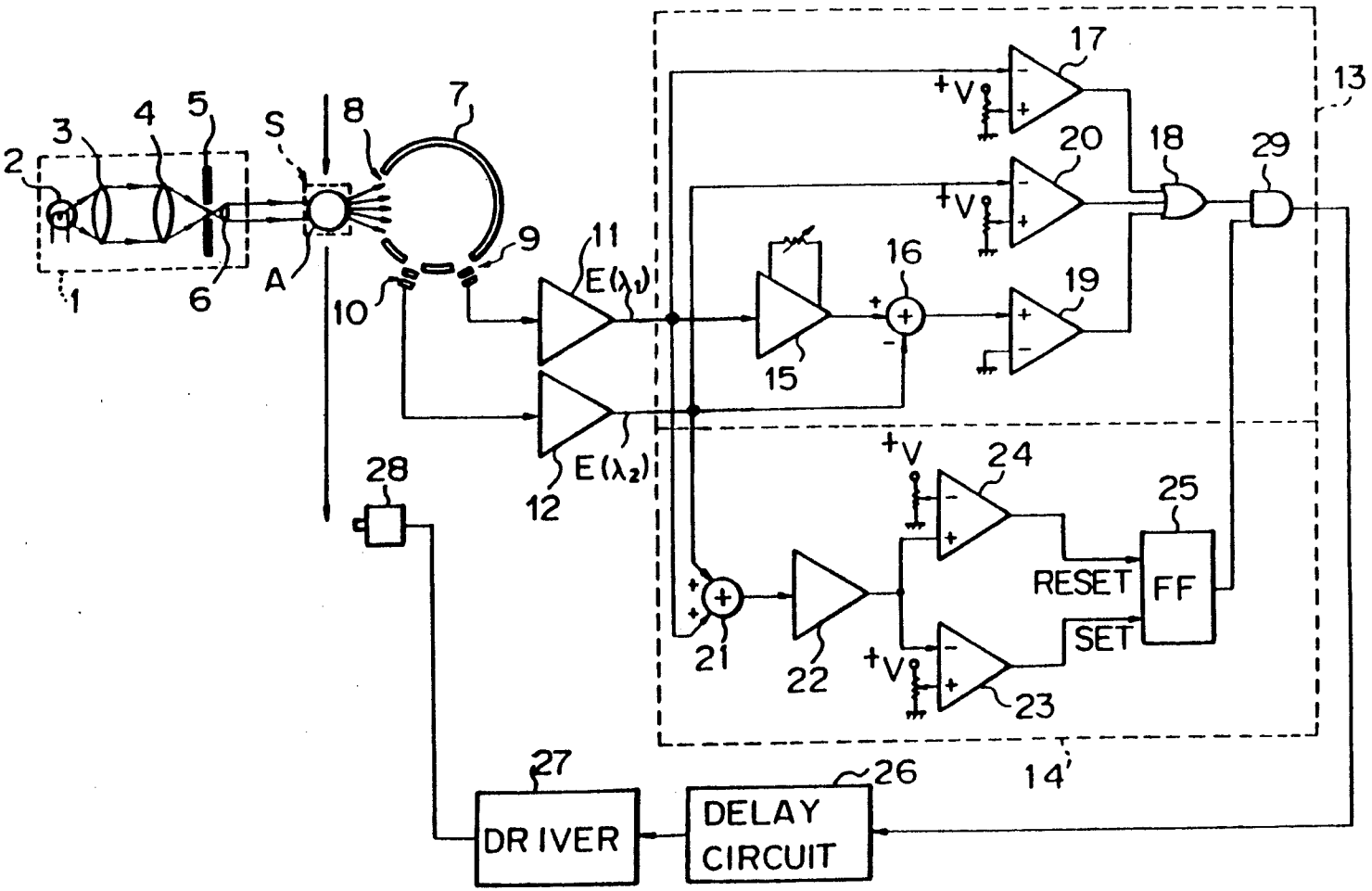
FIG. 3 is block diagram showing the arrangement of one embodiment of the sorting apparatus according to the present invention.

In FIG. 3, which is a block diagram showing one embodiment of the sorting apparatus according to the present invention, a light irradiator 1 is shown which comprises an electric lamp 2, together with a first lens 3, a second lens 4, a slit 5 and a third lens 6, all of which are arranged in the above order in a direction away from the electric lamp 2. Light that is emitted from the electric lamp 2 is condensed through the first and second lenses 3 and 4, narrowed by the slit 5 and then formed into parallel rays through the third lens 6. As a result, a beam of light which has a smaller diameter than an article (nut) A to be sorted is applied to the article A from the irradiator 1.

The reference numberal 7 denotes an integrating sphere which is disposed so as to face the irradiator 1 across an observation position S, the integrating sphere 7 being adapted to efficiently condense light entering through a window 8 therein.

The integrating sphere 7 is provided with a filter and a pair of photoelectric transducers 9 and 10 comprising photodiodes. The photoelectric transducers 9 and 10 detect light having a wavelength ($\lambda_1$) of 750 nm and light having a wavelength ($\lambda_2$) of 1100 nm, respectively, convert the detected light into corresponding electric signals and supply the electric signals to a plane dividing circuit 13 and a judging point detecting circuit 14 through amplifiers 11 and 12, respectively. The output level of each of the amplifiers 11 and 12 constitutes a signal which lowers in accordance with the transmission factor of each individual article A passing the observation position S.

In the plane dividing circuit 13, the electric signal [$E(\lambda_1)$] outputted from the amplifier 11 is supplied to a variable-gain amplifier 15. The amplifier 15 amplifies the electric signal supplied from the amplifier 11 by a predetermined gain k and supplies the amplified signal [$k \cdot E(\lambda_1)$9 to an adder 16.

The output of the amplifier 11 is also supplied to the inverting terminal of a comparator 17. The noninverting terminal of the comparator 17 is supplied with a predetermined positive reference potential. Accordingly, when the voltage of the signal that is supplied to the inverting terminal is lower than the reference potential, the comparator 17 outputs a signal representative of the logic "1" to an OR gate 18. It should be noted that the reference potential is set at an extremely low level, as shown at the top of the timing chart of FIG. 4, so that the reference potential intersects the output [$E(\lambda_1)$] of the amplifier 11 when a substance other than nuts, for example, a stone, which does not transmit any light at all passes the observation position S.

In the plane dividing circuit 13, the electric signal [$E(\lambda_2)$] outputted from the amplifier 12 is supplied to the adder 16 where it is subtracted from the output of the amplifier 15, and the subtraction result, i.e., [$kE(\lambda_1)-E(\lambda_2)$], is supplied to the noninverting terminal of a comparator 19.

The inverting terminal of the comparator 19 is grounded. Accordingly, when the output of the adder 16 is positive, the comparator 19 supplies a signal representative of the logic "1" to the OR gate 18. As has already been described, the transmission factor ratio [$E(\lambda_2)/E(\lambda_1)$] for defective articles is higher than the ratio [$E(\lambda_2)/E(\lambda_1)$] for non-defective articles. Accordingly, if the gain k is set at the median value between these ratios, when a non-defective article passes the observation position S, the output of the adder 16 is negative, whereas, when a defective article passes there, the output is positive.

The output of the amplifier 12 is also supplied to a comparator 20 in the plane dividing circuit 13. The function of the comparator 20 is the same as that of the above-described comparator 17 and description thereof is therefore omitted.

Figure 5:
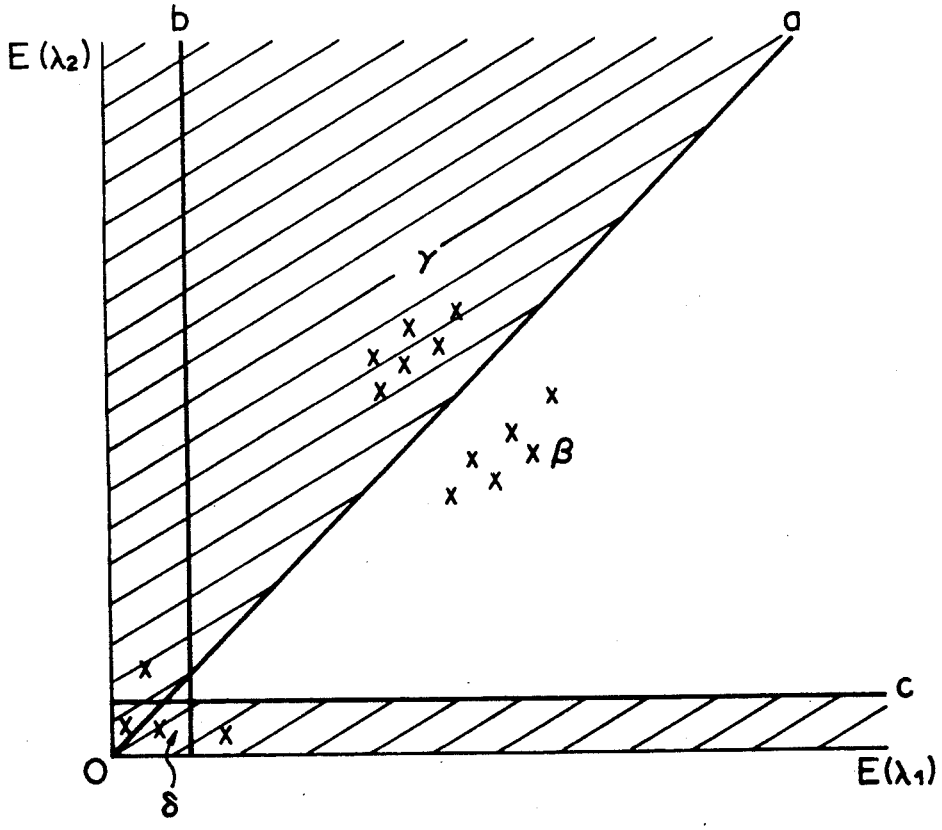
FIG. 5 is a graph showing sorting zones defined by a sorting method employing intensities of light having specific wavelengths as functions.

The functions of the plane dividing circuit 13 described above are collectively shown in FIG. 5. FIG. 5 shows a coordinate system in which $E(\lambda_2)$ is plotted along the axis of ordinate and $E(\lambda_1)$ is plotted along the axis of abscissa. As to the signal $E(\lambda_1)$ that is outputted from the amplifier 11, when this signal is lower than the reference value, the output of the comparator 17 is "1". As to the signal $E(\lambda_2)$ that is outputted from the amplifier 12, when this signal is lower than the reference value, the output of the comparator 20 is "1". As to the outputs of the amplifiers 11 and 12, when the relationship between $E(\lambda_1)$ and $E(\lambda_2)$ satisfies the condition of $kE(\lambda_1)-E(\lambda_2)>0$, the output of the comparator 19 is "1". More specifically, when the outputs $E(\lambda_1)$ and $E(\lambda_2)$ of the amplifiers 11 and 12 are within the hatched region, which is defined by the straight lines a, b and c, shown in FIG. 5, the output of the OR gate 18 is "1" and, at this time, the article under inspection is rejected.

The output of the OR gate 18 is supplied to an AND gate 29.

In the judging point detecting circuit 14, the outputs of the amplifiers 11 and 12 are supplied to an adder 21 where these outputs are added together, and the result of the addition is then supplied to a differentiating circuit 22.

The differentiating circuit 22 differentiates the output of the adder 21 and supplies the result to the inverting terminal of a comparator 23 and also to the noninverting terminal of a comparator 24.

The noninverting terminal of the comparator 23 and the inverting terminal of the comparator 24 are each supplied with a reference voltage. Accordingly, the comparator 23 outputs a signal representative of the logic "1" when the signal from the adder 21 falls, that is, when the output of the differentiating circuit 22 is negative, whereas the comparator 24 outputs a signal representative of the logic "1" when the signal from the adder 21 rises, that is, when the output of the differentiating circuit 22 is positive.

The outputs of the comparators 23 and 24 are supplied respectively to the set and reset terminals of a flip-flop (FF) 25 to set and reset it. More specifically, when an article under inspection enters the observation position S thus intercepting the light from the irradiator 1 and consequently the outputs of the amplifiers 11 and 12 begin to fall, the output of the comparator 23 becomes "1" and the FF 25 is therefore set; whereas, when the article has passed the observation position S and consequently the outputs of the amplifiers 11 and 12 begin to rise, the output of the comparator 24 becomes "1" and the FF 25 is therefore reset.

The signal from the FF 25 is supplied to the AND gate 29 to time operation of the quality judging signal supplied from the OR gate 18 when each individual article passes the observation position S. More specifically, when a defective article has passed the observation position S, the AND gate 29 outputs a signal representative of the logic "1", which is supplied to a driver 27 after being delayed by a predetermined time in a delay circuit 26.

When receiving a signal indicating that the article concerned is defective from the delay circuit 26, the driver 27 activates an ejector 28 to eject the relevant article.

Figures 4, 4A, 4B:
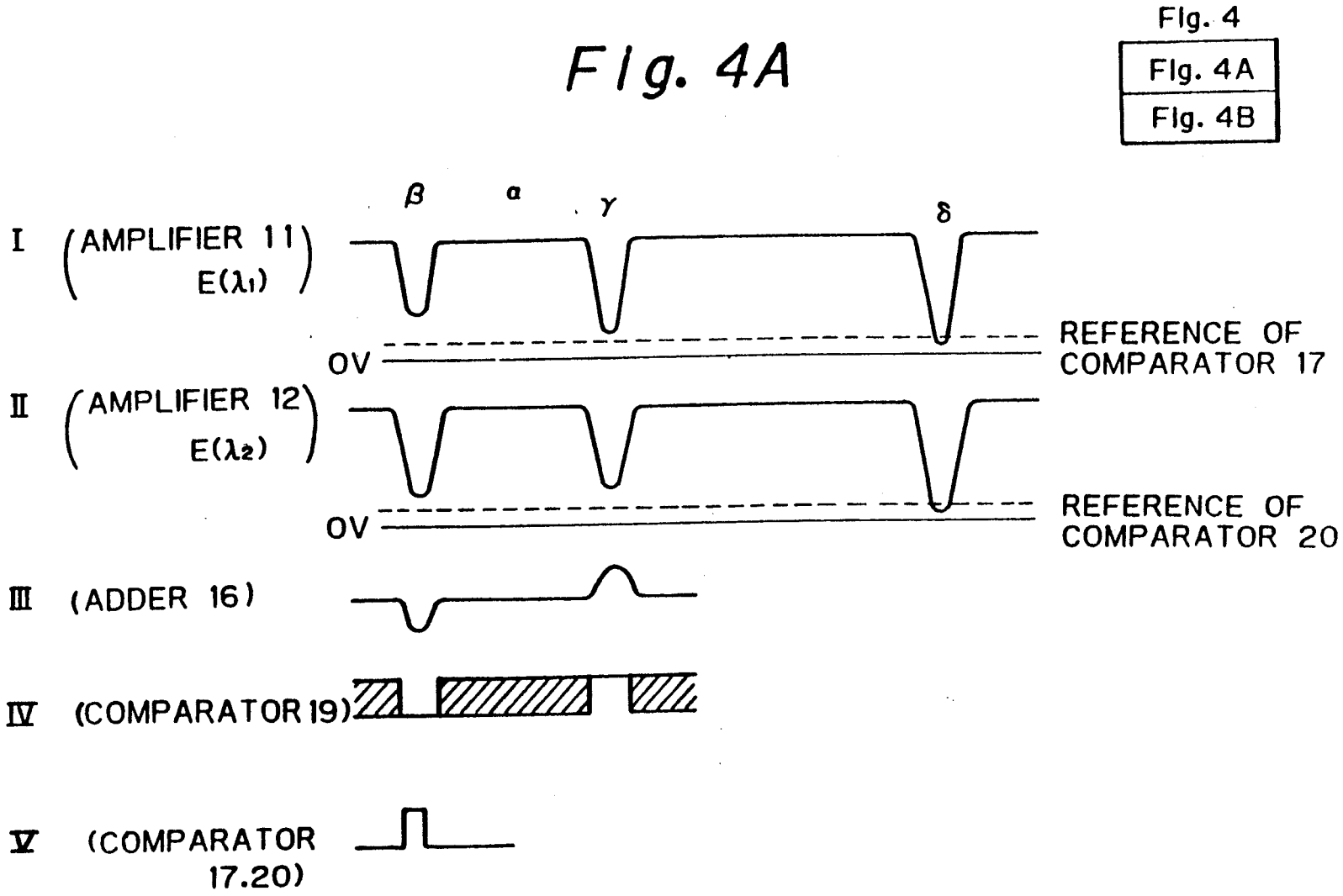
FIG. 4 consisting of FIGS. 4A and 4B, is a timing chart showing the operation of the sorting apparatus shown in FIG. 3.
Figure 4B:
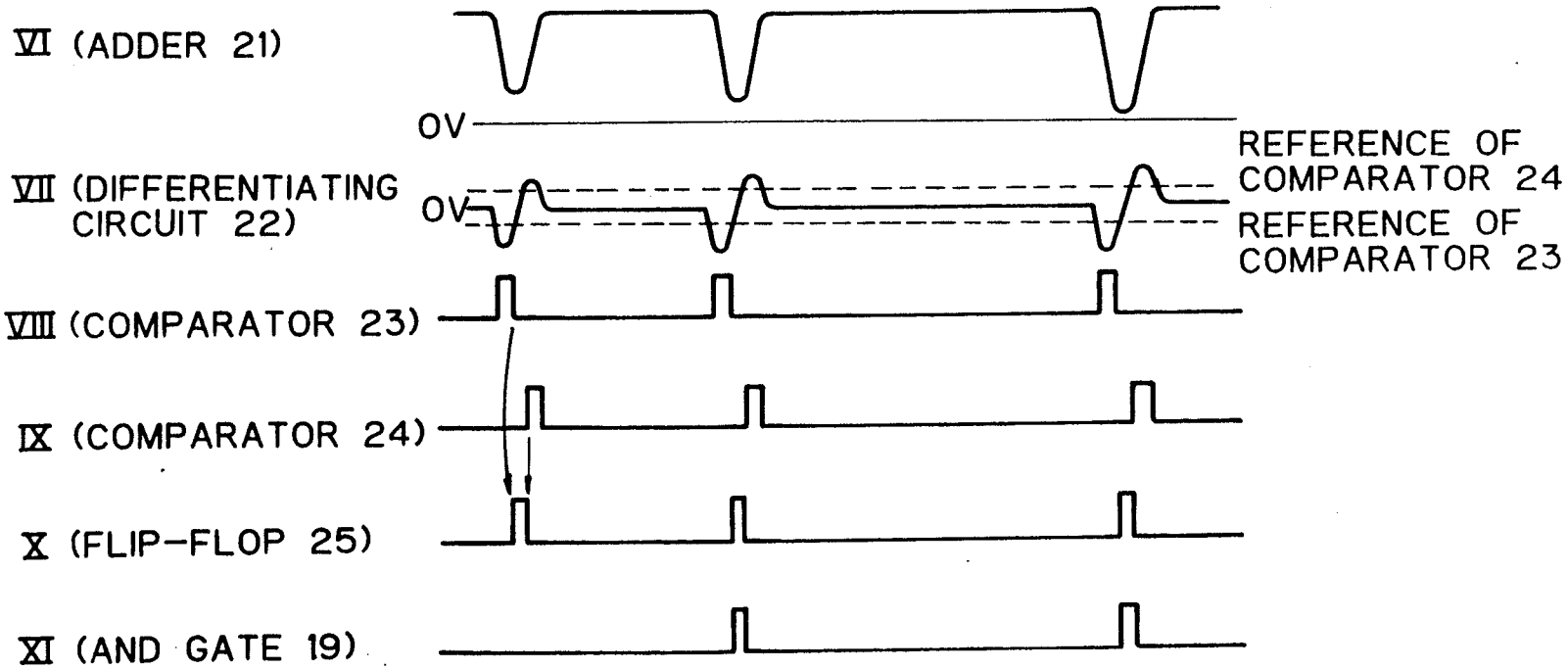

The following is a description of the operation of the sorting apparatus having the above-described arrangement. Referring to FIG. 4, the symbols $\alpha$, $\beta$, $\gamma$ and $\delta$, respectively, indicate: that no article is present at the observation position S; that a non-defective article is present at the observation position S; that a defective article is present at the observation position S; and that foreign matter, for example, a stone, is present at the observation position S. FIG. 5 shows the positions of $\alpha$, $\beta$ and $\gamma$ on the $E(\lambda_1)-E(\lambda_2)$ coordinate system.

When no nut A is present at the observation position S, the light from the irradiator 1 is directly condensed by the integrating sphere 7, and among the condensed light two different kinds of light which have specific wavelengths ($\lambda_1$) and ($\lambda_2$) are detected by the photoelectric transducers 9 and 10 and amplified in the amplifiers 11 and 12, respectively. These amplified signals are flat signals having no changes (see the portion $\alpha$ in each of FIGS. 4I and 4II). Accordingly, the output of the differentiating circuit 22 is maintained at zero, the outputs of the comparators 23 and 24 are "0", and the FF 25 is therefore not activated. As a result, the output of the AND gate 29 is "0", and the ejector 28 is not activated.

The following is an explanation of the operation taking place when a non-defective article passes the observation position S. Since the diameter of the light applied from the irradiator 1 is smaller than that of the nut A, when the nut A is present at the observation position S, it intercepts all the light applied from the irradiator 1 and there is therefore no possibility that light from the irradiator 1 will directly reach the integrating sphere 7.

The light that is applied to the nut A passes through the internal part thereof while being diffused and reaches the integrating sphere 7. From among the light transmitted into the integrating sphere 7, the above-described specific rays of light are detected by the photoelectric transducers 9 and 10 and amplified in the amplifiers 11 and 12, respectively. The amplified signals $E(\lambda_1)$ and $E(\lambda_2)$ are supplied to the adder 21 where the two signals are added together (see FIG. 4VI), and the result of the addition is supplied to the differentiating circuit 22. In the differentiating circuit 22, the output of the adder 21 is differentiated (see FIG. 4VII), and then supplied to the comparators 23 and 24. In consequence, when the output of the differentiating circuit 22 falls, the FF 25 is set by the comparator 23, and when the output of the differentiating circuit 22 rises, the FF 25 is reset by the comparator 24 (see FIGS. 4VIII, 4IX and 4X). Thus, a signal indicating that the article concerned has passed the observation position S is supplied from the FF 25 to the AND gate 29.

In this case, the levels of the signals $E(\lambda_1)$ and $E(\lambda_2)$ from the amplifiers 11 and 12 are lower than in the case where no nut is present at the observation position S (see $\beta$ in each of FIGS. 4I and 4II). At this time, the low levels of the signals are higher than the reference voltage for the comparators 17 and 20 because of the slight amount of transmitted light reaching the integrating sphere 7, and the outputs of the comparators 17 and 20 are therefore "0". Since the nut A passing the observation position S is non-defective, the condition of $kE(\lambda_1)-E(\lambda_2)<0$ is satisfied, and the output of the comparator 19 is also "0" (see FIG. 4IV). Accordingly, a signal representative of the logic "0" is outputted from the OR gate 18 and the AND gate 29. In consequence, when a non-defective article passes the observation position S, the ejector 28 is not activated, so that the nut A passing there is not ejected.

The following is an explanation of the operation taking place when a defective article passes the observation position S (see $\gamma$ shown in FIG. 4). When a defective article passes the observation position S, although the outputs of the comparators 17 and 20 are "0", the condition of $kE(\lambda_1)-E(\lambda_2)>0$ is satisfied, and the output of the comparator 19 is therefore "1" (see FIG. 4IV). This signal is supplied to the AND gate 29.

In the meantime, the AND gate 29 is supplied with an article passing signal from the FF 25, as described above. In consequence, the AND gate 29 outputs an eliminating signal to the delay circuit 26 (see FIG. 4XI), so that the driver 27 is activated with a predetermined delay to drive the ejector 28. As a result, the defective nut is ejected.

When a foreign material, for example, a stone, passes the observation position S (see $\delta$ in FIG. 4), no light is transmitted and the resulting levels of the outputs of the amplifiers 11 and 12 are lower than the reference voltage for the comparators 17 and 20 (see FIG. 4II). In consequence, a signal representative of the logic "1" is outputted from each of the comparators 17 and 20 (see FIG. 4V) and supplied to the AND gate 29 through the OR gate 18. Thus, since the AND gate 29 is supplied with an article passing signal from the FF 25, a signal representative of the logic "1" is outputted from the AND gate 29 (see FIG. 4XI). As a result, the foreign matter is eliminated by the ejector 28.

Figure 6A:
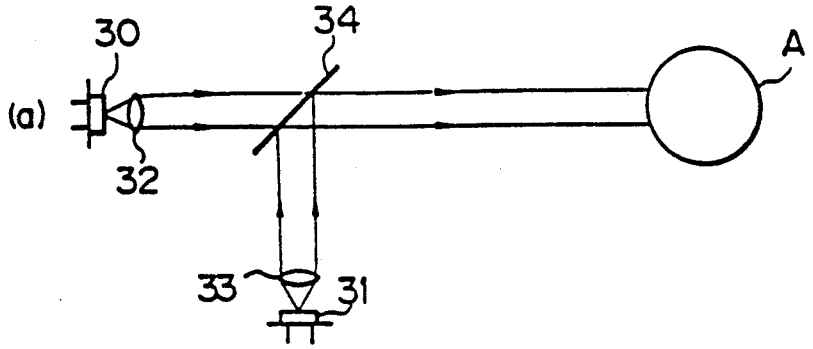
FIGS. 6(*a*) and 6(*b*) are block diagrams respectively showing other examples of the light irradiator employed in the present invention.
Figure 6B:
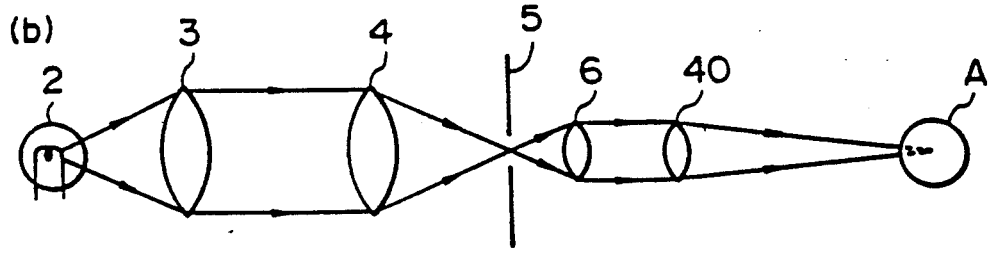

FIGS. 6(*a*) and 6(*b*) are block diagrams respectively showing other examples of the light irradiator described above. In the arrangement shown in FIG. 6(*a*), rays of light from two laser oscillators 30 and 31, which emit two different kinds of light having the specific wavelengths ($\lambda_1$) and ($\lambda_2$), are narrowed through lenses 32 and 33, respectively, to form light beams, which are mixed together through a dichroic mirror 34 and then applied to an article A under inspection.

In the arrangement shown in FIG. 6(*b*), a lens 40 is additionally provided in the light irradiator shown in FIG. 3 to irradiate the article A with light which has been further narrowed.

Figure 7:
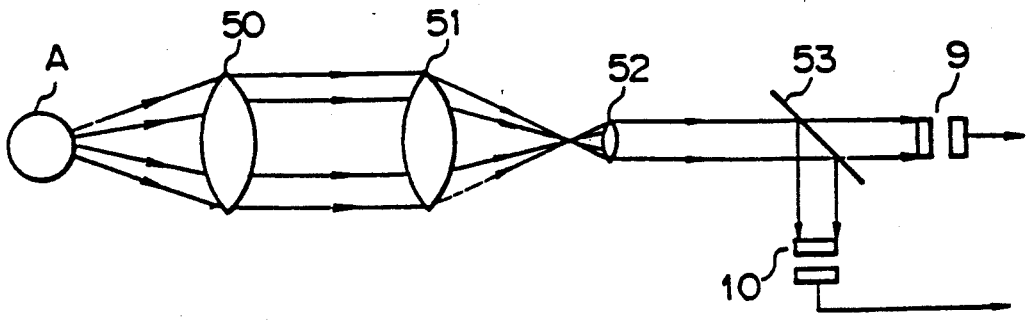
FIG. 7 is a block diagram showing another example of the light condenser employed in the present invention.

FIG. 7 shows yet another example of the device for concentrating the rays of light transmitted through the article A. The rays of light transmitted through the article A are condensed through lenses 50, 51, 52 and then applied to a dichroic mirror 53 where the condensed light is separated into two beams of light, which are supplied to the photoelectric transducers 9 and 10, respectively.

As has been described above, the present invention provides a sorting apparatus utilizing transmitted light to determine whether or not an article under inspection is defective and thus eliminates the article when determined to be defective. The device comprises a light irradiator for irradiating the article under inspection with a light beam having a smaller diameter than the diameter of the article; a light condenser for condensing the rays of light transmitted through the article while being diffused; two light detecting means for respectively detecting two specific kinds of light having different wavelengths among the condensed rays of transmitted light; and a judging means for judging whether or not the article is defective by obtaining a ratio between the intensities of the two specific kinds of light detected by the light detecting means and judging whether or not the obtained ratio is higher than a predetermined value. It is therefore possible to sort out even an article which has no surface color change despite an internal deterioration change in quality.

The present invention further comprises a discriminating means for discriminating a foreign matter, that is, an article different than that type of material under inspection by detecting that the intensities of the specific light detected by the light detecting means are lower than a predetermined value. Accordingly, even if a foreign material, for example, a stone, which does not transmit any light at all is present in articles under inspection, it can be eliminated.

Although the present invention has been described through specific terms, it should be noted that the described embodiments are not necessarily exclusive and various changes and modifications may be imparted thereto without departing from the scope of the invention which is limited solely by the appended claims.

What is claimed is:

1. A sorting apparatus utilizing transmitted light to determine whether an article under inspection is defective or not and thus eliminating the article when determined to be defective, comprising:

a light irradiator irradiating said article with a light beam having a smaller diameter than that of said article;

a light condenser condensing the rays of light transmitted through said article while being diffused, said light condenser being positioned diametrically opposite said light irradiator;

two light detecting means for respectively detecting two specific kinds of light having different wavelengths among the condensed rays of transmitted light; and a judging means for judging whether said article is defective or non-defective by obtaining a ratio between the intensities of the two specific kinds of light detected by said light detecting means and judging whether or not the obtained ratio is higher than a predetermined value.

2. A sorting apparatus according to claim 1, further comprising discriminating means for discriminating an article of a different kind from the kinds articles under inspection by detecting that the intensities of said specific light detected by said light detecting means are lower than a predetermined value.

3. A sorting apparatus as claimed in claim 1, wherein said light beam from said light irradiator has a wavelength of 500 nm to 1400 nm.

4. A sorting apparatus as claimed in claim 1, wherein said two light detecting means detect, respectively, light having wavelengths of 750 nm and 1100 nm.

5. A nut-sorting apparatus utilizing transmitted light to determine whether any nut under inspection is defective and to eliminate any nut which is determined to be defective, said nut-sorting apparatus comprising:

a light irradiator radiating said nut with a light beam to determine whether said nut is defective, said light irradiator providing a light beam of a diameter smaller than said nut being irradiated;

a light condenser condensing the rays of light from said light irradiator transmitted through said nut while being defused, said light condenser being positioned diametrically opposite said light irradiator;

two light detecting means for respectively detecting two specific kinds of light having different wavelengths among the condensed rays of transmitted light; and a judging means for judging whether said nut is defective or non-defective by obtaining a ratio between the intensities of the two specific kinds of light detected by said two light detecting means and judging whether or not the obtained ratio is higher than a predetermined value.

6. A nut sorting apparatus as claimed in claim 5, wherein said light beam from said light irradiator has a wavelength of 500 nm to 1400 nm.

7. A nut sorting apparatus as claimed in claim 5, wherein said two light detecting means detect, respectively, light having wavelengths of 750 nm and 1100 nm.

8. A nut sorting apparatus as claimed in claim 5, wherein said apparatus determines the presence of any fungus contaminating said nut.

9. A sorting apparatus utilizing transmitted light to determine whether an article under inspection is defective, said apparatus comprising:

a light source irradiating said article under inspection with a beam of light having a diameter smaller than said article under inspection;

a light condenser positioned diametrically opposite said light source, said light condenser condensing rays of light from said light source diffused through said article;

at least two light detecting means, each of said light detecting means respectively detecting a different one of at least two specific and different wave lengths of light condensed by said light condenser; and, judging means for judging whether said article is defective by obtaining a ratio between the intensities of said at least two specific and different wavelengths detected by said light detecting means and determining whether the ratio is higher than a predetermined value.

10. An apparatus as claimed in claim 9, further comprising discriminating means for discriminating an article of a different kind from the kind of articles under inspection by detecting that the intensities of said wavelengths of light detected by said light detecting means are lower than a predetermined value.

11. A sorting apparatus as claimed in claim 9, wherein said light beam from said light irradiator has a wavelength of 500 nm to 1400 nm.

12. A sorting apparatus as claimed in claim 9, wherein two light detecting means detect, respectively, light having wavelengths of 750 nm and 1100 nm.

* * * * *